US012383784B2

(12) United States Patent
McLaughlin

(10) Patent No.: US 12,383,784 B2
(45) Date of Patent: Aug. 12, 2025

(54) MAGNETICALLY COUPLED BARBELL PAD AND RELATED METHODS

(71) Applicant: LiftMo LLC, Orlando, FL (US)

(72) Inventor: Haley McLaughlin, Oviedo, FL (US)

(73) Assignee: LIFTMO LLC, Orlando, FL (US)

( * ) Notice: Subject to any disclaimer, the term of this patent is extended or adjusted under 35 U.S.C. 154(b) by 108 days.

(21) Appl. No.: 18/502,222

(22) Filed: Nov. 6, 2023

(65) Prior Publication Data

US 2024/0149099 A1 May 9, 2024

Related U.S. Application Data

(60) Provisional application No. 63/422,673, filed on Nov. 4, 2022.

(51) Int. Cl.
*A63B 21/078* (2006.01)
*A63B 21/072* (2006.01)

(52) U.S. Cl.
CPC ..... *A63B 21/0783* (2015.10); *A63B 21/0724* (2013.01); *A63B 2209/08* (2013.01)

(58) Field of Classification Search
CPC ..... A63B 21/0783; A63B 21/0724; A63B 2209/08; A63B 2209/00; A63B 2209/10
See application file for complete search history.

(56) References Cited

U.S. PATENT DOCUMENTS 2,984,486 A * 5/1961 Jones ..... A63B 60/08 473/568
4,017,070 A * 4/1977 Hilton ..... A63B 69/00 434/247
4,588,191 A * 5/1986 Stewart ..... A63B 69/3638 273/DIG. 30
5,415,607 A * 5/1995 Carpenter ..... A63B 21/4001 482/106
5,460,378 A * 10/1995 Getts ..... A63B 69/3638 473/238
6,083,116 A * 7/2000 Loredo ..... A63B 69/3638 473/256
6,224,518 B1 * 5/2001 Weiss ..... A63B 21/078 482/106
6,604,789 B1 * 8/2003 Downing ..... A47C 31/11 5/663

(Continued)

FOREIGN PATENT DOCUMENTS

GB 2504722 2/2014

OTHER PUBLICATIONS

Gopher Sport "Gopher Magnetic Barbell Pad" https://www.gophersport.com/product-and-service-delay: Retrieved from internet May 1, 2022; pp. 4.

*Primary Examiner* — Garrett K Atkinson
(74) *Attorney, Agent, or Firm* — Allen, Dyer, Doppelt + Gilchrist, PA

(57) ABSTRACT

A barbell pad includes a base having first and second arms, and a curved channel between the first and second arms. The first and second arms extend laterally away from the curved channel, and the first and second arms extend in opposite directions. The barbell pad also includes magnets carried by the base within the curved channel and to be magnetically coupled to a barbell, and a flexible pad coupled to the base opposite to the magnets to distribute weight load from the barbell.

20 Claims, 6 Drawing Sheets

(56) References Cited

U.S. PATENT DOCUMENTS 6,676,575 B1 * 1/2004 Mayo ..... A63B 23/0211 482/148
7,175,572 B2 * 2/2007 Stonecipher ..... A63B 21/072 482/106
7,490,361 B1 * 2/2009 Floyd ..... A63B 21/4005 2/94
7,494,451 B1 * 2/2009 Ramos ..... A63B 21/0728 482/148
7,588,500 B2 * 9/2009 Hoeckl ..... A63B 69/3638 473/226
8,128,541 B2 * 3/2012 Hartman ..... A63B 21/4017 482/122
D688,338 S * 8/2013 Bisson ..... D21/694
8,500,609 B1 * 8/2013 Williams ..... A63B 21/0726 135/65
9,138,613 B2 * 9/2015 Ferrell ..... A63B 21/078
9,656,120 B1 * 5/2017 Franco ..... A63B 24/0062
9,839,806 B2 * 12/2017 Slaughter ..... A63B 21/0728
9,907,993 B2 * 3/2018 Penney ..... A63B 21/4035
10,806,987 B2 * 10/2020 Burns ..... A63B 21/4035
D945,108 S * 3/2022 Walker ..... D34/27
11,266,870 B2 * 3/2022 Leadbetter ..... A63B 21/0724
D980,928 S * 3/2023 Hetrick ..... D21/694
D985,697 S * 5/2023 Hetrick ..... D21/694
11,896,889 B2 * 2/2024 Stubbers ..... A63B 71/1225
2001/0024999 A1 * 9/2001 Pappert ..... A63B 23/00 482/93
2001/0052710 A1 * 12/2001 Witherell ..... A63B 21/4035 294/137
2008/0040891 A1 * 2/2008 Tyler ..... A63B 21/4017 16/421
2009/0258765 A1 * 10/2009 Panicali ..... A63B 21/4035 482/106
2009/0275447 A1 * 11/2009 Fishman ..... A63B 21/072 482/139
2012/0129664 A1 * 5/2012 Perry ..... A63B 71/14 482/139
2013/0196824 A1 * 8/2013 Ross ..... A63B 1/005 482/40
2014/0274614 A1 * 9/2014 Newman ..... A63B 21/4035 482/139
2015/0065315 A1 * 3/2015 Ferrell ..... A63B 21/078 482/104
2016/0045809 A1 * 2/2016 Jones ..... A63B 71/0054 428/100
2016/0332022 A1 * 11/2016 Mathews ..... A63B 21/4035
2018/0021662 A1 * 1/2018 Carpinelli ..... A63B 21/0726 482/104
2018/0264313 A1 * 9/2018 Boysen ..... A63B 21/0724
2019/0001211 A1 * 1/2019 Burns ..... A63B 21/0724
2019/0059568 A1 * 2/2019 Orlando ..... A46B 5/0041
2022/0047910 A1 * 2/2022 Beck ..... A63B 21/0442
2022/0161122 A1 * 5/2022 Stubbers ..... A63B 23/0222
2022/0273978 A1 * 9/2022 Malave ..... A63B 21/00189
2022/0314060 A1 * 10/2022 Fogle ..... A63B 21/0728
2023/0123935 A1 * 4/2023 Staken ..... A63B 21/4035 482/139

* cited by examiner

MAGNETICALLY COUPLED BARBELL PAD AND RELATED METHODS

RELATED APPLICATION

This application is based upon prior filed Application No. 63/422,673 filed Nov. 4, 2022, the entire subject matter of which is incorporated herein by reference in its entirety.

TECHNICAL FIELD

The present disclosure relates to the field of exercise equipment, and, more particularly, to a weight lifting accessory device and related methods.

BACKGROUND

Exercise is widely accepted as a means of promoting and maintaining good health and wellbeing. Many forms of exercise equipment are used. In particular, barbells are widely used for many exercise movements. Barbells consist of a long bar ranging in length from 2 to 8 feet, often with disc shaped weights attached on each end. The barbell is used for free weight training and competitive sports to perform dynamic movements, such as the bench press, back squat, front squat, and hip thrusters. During these movements (especially squats and hip thrusters), heavy weights may be used, which may cause significant pressure on the contact points between the barbell and the user's body.

SUMMARY

Generally, a barbell pad comprises a base comprising first and second arms, and a curved channel between the first and second arms. The first and second arms extend laterally away from the curved channel, and the first and second arms extend in opposite directions. The barbell pad also includes a plurality of magnets carried by the base within the curved channel and to be magnetically coupled to a barbell, and a flexible pad coupled to the base opposite to the plurality of magnets to distribute weight load from the barbell.

In particular, each of the plurality of magnets may comprise a curve-shaped magnet, and each of the plurality of magnets may be recessed within the curved channel. The first and second arms may be substantially parallel to each other. The curved channel may comprise a semi-circle shaped channel, and the first and second arms may extend perpendicularly from ends of the semi-circle shaped channel. The flexible pad may comprise a first end coupled to the base, and a second end opposite to the first end, the second end being curve-shaped.

In some embodiments, the plurality of magnets may comprise first and second pairs of aligned magnets, and each of the first and second pairs of aligned magnets may comprise a first magnet within the curved channel adjacent to the first arm, and a second magnet within the curved channel adjacent to the second arm and aligned with the first magnet.

Also, the barbell pad may further comprise an adhesive layer between the base and the flexible pad. For example, the flexible pad may comprise a foam pad; and the base may comprise a polymer plastic material.

Another aspect is directed to a method for making a barbell pad. The method includes forming a base comprising first and second arms, and a curved channel between the first and second arms. The first and second arms extend laterally away from the curved channel, and the first and second arms extend in opposite directions. The method also includes positioning a plurality of magnets carried by the base within the curved channel and to be magnetically coupled to a barbell, and coupling a flexible pad to the base opposite to the plurality of magnets to distribute weight load from the barbell.

DETAILED DESCRIPTION

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout.

Figure 1:
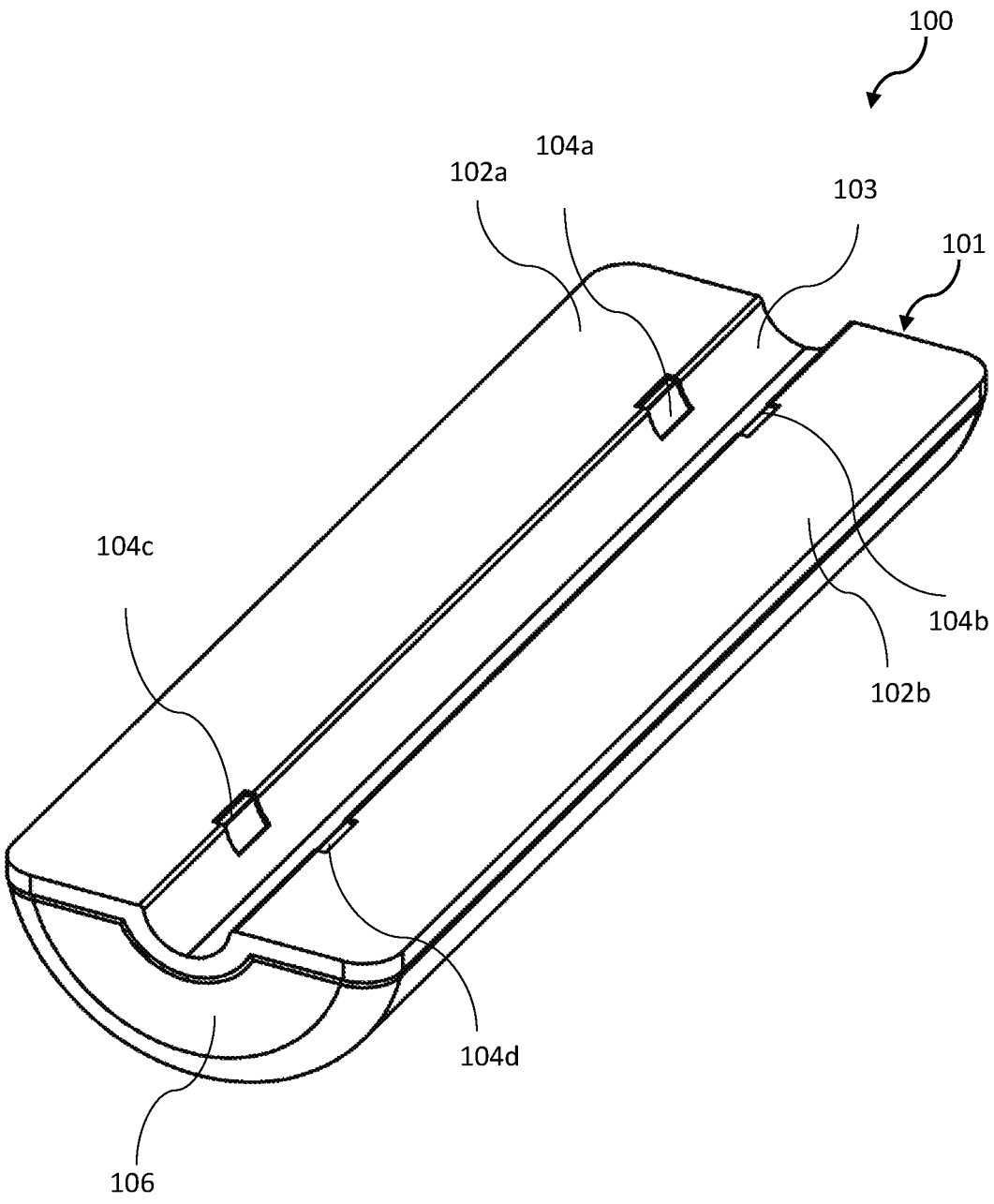
FIG. 1 is a perspective view of a barbell pad, according to the present disclosure.
Figure 2:
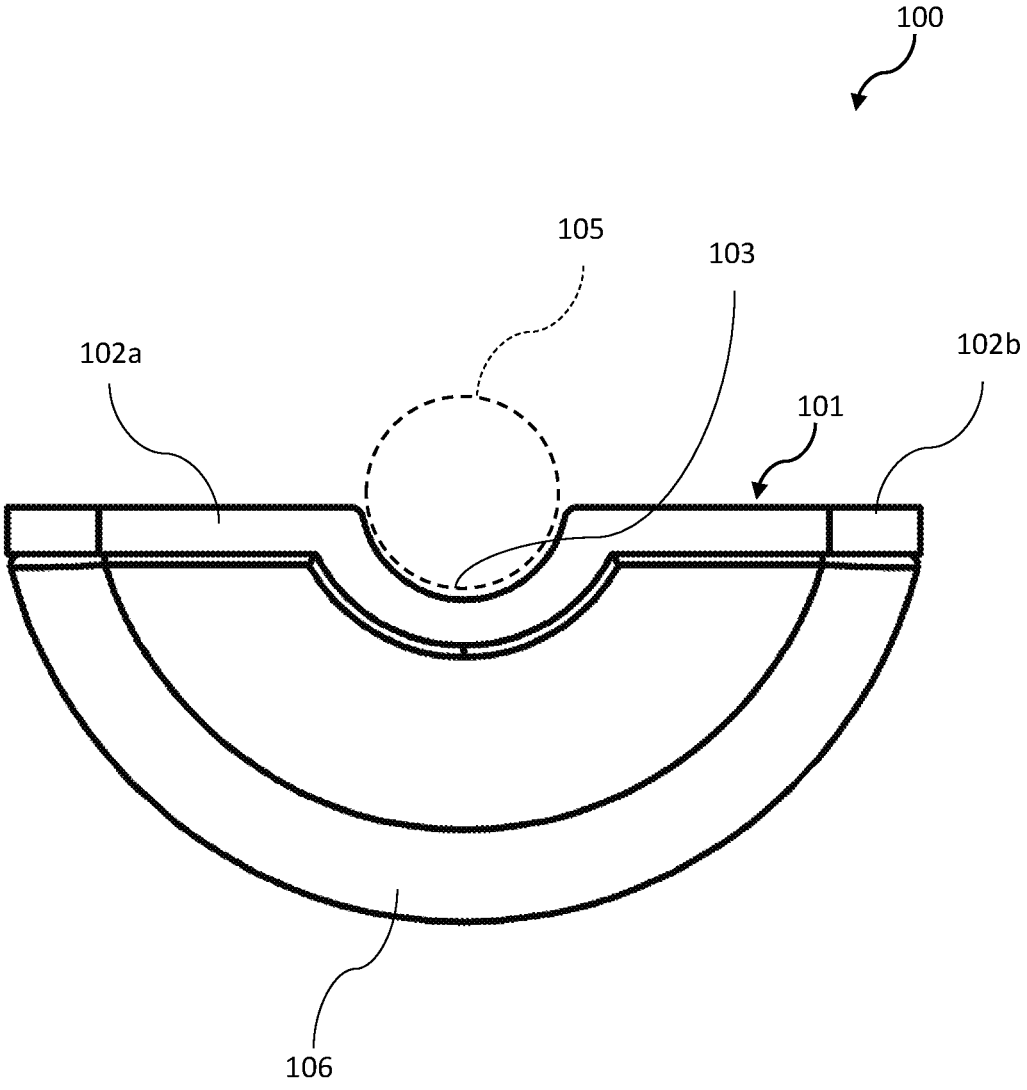
FIG. 2 is a side view of the barbell pad of FIG. 1.
Figure 3:
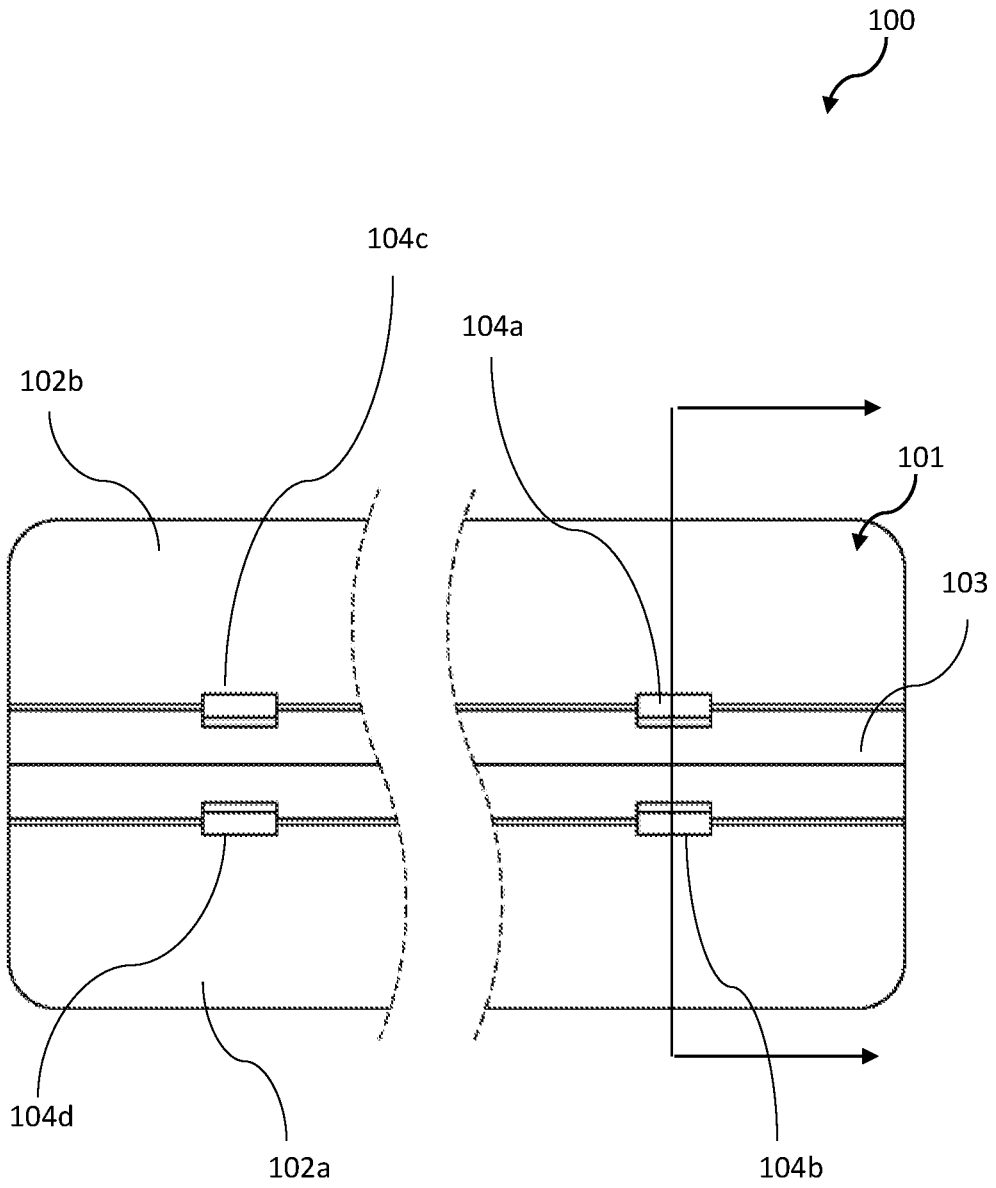
FIG. 3 is a top plan view of the barbell pad of FIG. 1.

Referring initially to FIGS. 1-3, a barbell pad 100 according to the present invention is now described. The barbell pad 100 comprises a base 101 comprising first and second arms 102*a*-102*b*, and a curved channel 103 between the first and second arms. In the illustrated embodiment, the curved channel 103 comprises a semi-circle shaped channel (i.e., an arc of 180°±10°). Of course, in other embodiments, the curved channel 103 may comprise other oblong shapes.

The first and second arms 102*a*-102*b* extend laterally away from the curved channel 103, and the first and second arms extend in opposite lateral directions. As perhaps best seen in FIG. 2, the first and second arms 102*a*-102*b* may be substantially parallel to each other (i.e., ±10° of parallel), and the curved channel 103 is centrally placed between the first and second arms 102*a*-102*b*. The first and second arms 102*a*-102*b* extend perpendicularly from ends of the semi-circle shaped channel. As shown in FIG. 3, the barbell pad 100 also includes a plurality of magnets 104*a*-104*d* carried by the base 101 within the curved channel 103 and to be magnetically and releasably coupled to a barbell 105.

Referring now additionally to FIGS. 4A-4B & 5A-5B, each of the plurality of magnets 104*a*-104*d* illustratively comprises a curve-shaped magnet, and each of the plurality of magnets may be partially or fully recessed within the curved channel 103. Here, the plurality of magnets 104*a*-104*d* comprises first and second pairs 104*a*-104*b*, 104*c*-104*c* of aligned magnets. As perhaps best seen in FIG. 5A, each of the first and second pairs 104*a*-104*b*, 104*c*-104*c* of aligned magnets comprises a first magnet within the curved channel 103 adjacent to the first arm 102*a*, and a second magnet within the curved channel adjacent to the second arm 102*b* and aligned with the first magnet. Helpfully, in combination with the recessed first and second pairs 104*a*-104*b*, 104*c*-104*c* of aligned magnets, this maintains a tight magnetic coupling to the barbell 105.

Figure 4A:
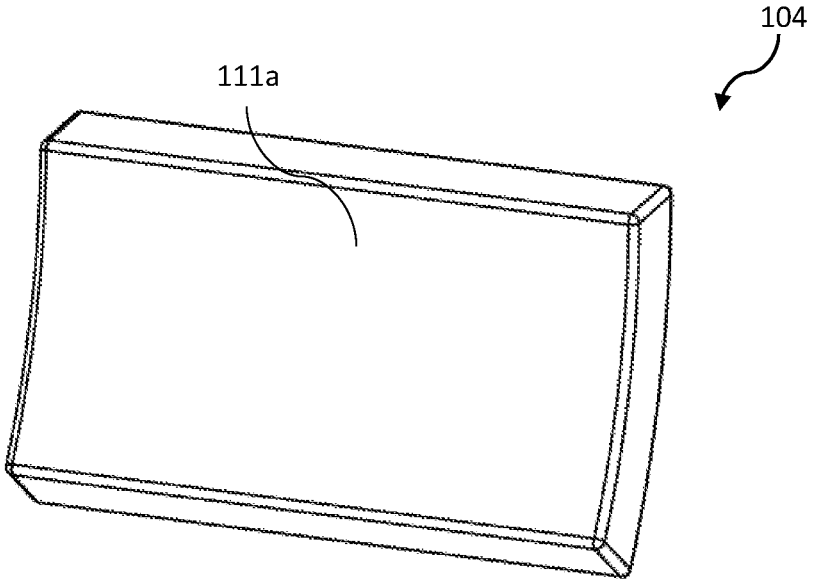
FIGS. 4A and 4B are perspective and side views of the magnet from the barbell pad of FIG. 1, respectively.
Figure 4B:
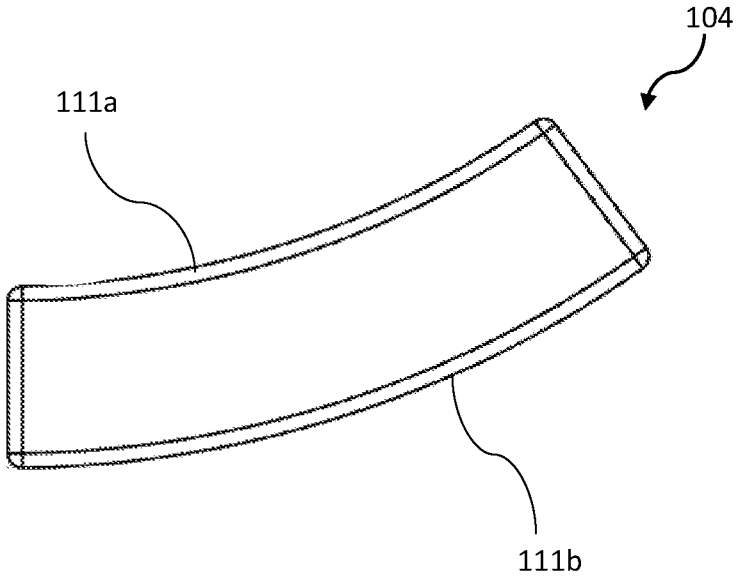
Figure 5A:
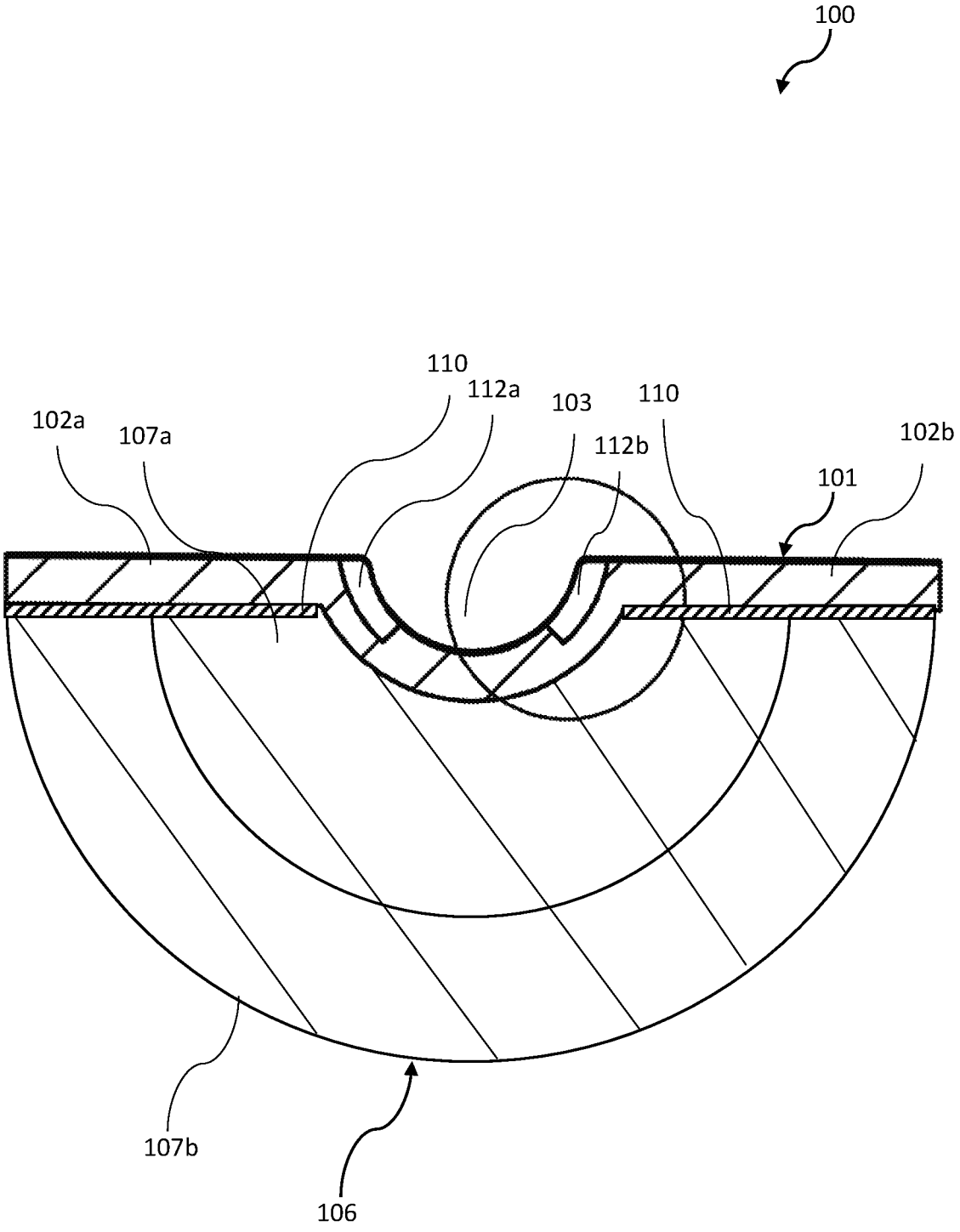
FIG. 5A is a cross-section view of the barbell pad of FIG. 1 along line 5-5 of FIG. 3 without the magnets.
Figure 5B:
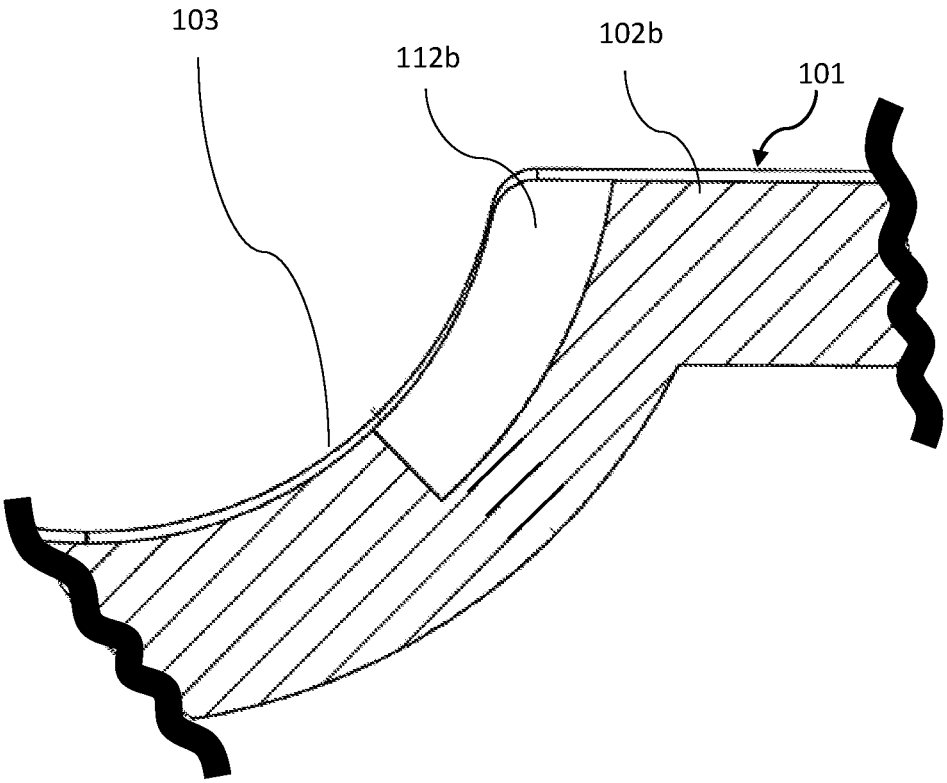
FIG. 5B is an enlarged cross-section view from FIG. 5A without the flexible pad.

As perhaps best seen in FIGS. 4A-4B, each of the plurality of magnets 104*a*-104*d* illustratively has a curved rectangular box shape. Also, each of the plurality of magnets 104*a*-104*d* comprises a first convex side 111*a*, and a second concave side 111*b* opposite to the first convex side. The second concave side 111*b* is to be positioned within matching recesses 112*a*-112*b* within the curved channel 103.

The barbell pad 100 also includes a flexible pad 106 coupled to the base 101 opposite to the plurality of magnets 104*a*-104*d*. The flexible pad 106 cooperates with the base 101 to distribute weight load from the barbell 105. The flexible pad 106 comprises a first end 107*a* coupled to the base 101, and a second end 107*b* opposite to the first end. The second end 107*b* is illustratively curve-shaped to better cushion the associated weight carried by the barbell 105 for the user. As perhaps best seen in FIGS. 2 & 5A, the flexible pad 106 is illustratively substantially semi-cylinder shaped.

Also, the barbell pad 100 further comprises an adhesive layer 110 between the base 101 and the flexible pad 106. For example, the flexible pad 106 may comprise a foam pad. The base 101 may comprise a rigid material with sufficient mechanical strength to not deform under typical barbell weights. For example, the base 101 may comprise a polymer plastic material, or a metallic compound.

Another aspect is directed to a method for making a barbell pad 100. The method includes forming a base 101 comprising first and second arms 102*a*-102*b*, and a curved channel 103 between the first and second arms. The first and second arms 102*a*-102*b* extend laterally away from the curved channel 103, and the first and second arms extend in opposite directions. The method also includes positioning a plurality of magnets 104*a*-104*d* carried by the base 101 within the curved channel 103 and to be magnetically coupled to a barbell 105, and coupling a flexible pad 106 to the base opposite to the plurality of magnets.

Yet another aspect is directed to a method for using a barbell pad 100 with a barbell 105 and associated desired weight. The barbell pad 100 includes a base 101 comprising first and second arms 102*a*-102*b*, and a curved channel 103 between the first and second arms. The first and second arms 102*a*-102*b* extend laterally away from the curved channel 103, and the first and second arms extend in opposite directions. The barbell pad 100 also includes a plurality of magnets 104*a*-104*d* carried by the base 101 within the curved channel 103, and a flexible pad 106 coupled to the base opposite to the plurality of magnets to distribute weight load from the barbell. The method comprises releasably and magnetically coupling the barbell pad 100 to the barbell 105, and performing at least weight training exercise with the barbell pad and the barbell.

Advantageously, the barbell pad 100 is easily magnetically and releasably coupled to the barbell 105. In a typical application, the user would releasably couple the barbell pad 100 to the barbell 105, which is carrying a desired amount of weight. During one or more weight training exercises (e.g., a hip thrust exercise, a squat exercise, or other lift exercise using a barbell), the barbell pad 100 provides a cushion/distribution device to the user from the pressure from desired amount of weight.

Further, the magnetic coupling is secure and strong so as not to disrupt weight training exercises from the user. As will be appreciated, one common reason for users to avoid using typical barbell pads is the extra step of fitting the pad onto the barbell. The barbell pad 100 provides an approach to this issue with quick magnetic coupling. Another common reason for users to avoid using typical barbell pads is dislodging of the pad during exercises (e.g., shifting forward/backward/diagonally or longitudinal sliding). The barbell pad 100 provides an approach to this issue with reliable magnetic coupling. Further, the central placement of the curved channel 103 naturally balances the weight on the barbell pad 100.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. A barbell pad comprising:

a base comprising first and second arms, and a curved channel between the first and second arms, the first and second arms extending laterally away from the curved channel, the first and second arms extending in opposite directions;

a plurality of magnets carried by the base within the curved channel and configured to be magnetically coupled to a barbell; and a flexible pad coupled to the base opposite to the plurality of magnets to distribute weight load from the barbell.

2. The barbell pad of claim 1 wherein each of the plurality of magnets comprises a curve-shaped magnet; and wherein each of the plurality of magnets is recessed within the curved channel.

3. The barbell pad of claim 1 wherein the first and second arms are substantially parallel to each other.

4. The barbell pad of claim 1 wherein the curved channel comprises a semi-circle shaped channel; and wherein the first and second arms extend perpendicularly from ends of the semi-circle shaped channel.

5. The barbell pad of claim 1 wherein the flexible pad comprises a first end coupled to the base, and a second end opposite to the first end, the second end being curve-shaped.

6. The barbell pad of claim 1 wherein the plurality of magnets comprises first and second pairs of aligned magnets, each of the first and second pairs of aligned magnets comprises a first magnet within the curved channel adjacent to the first arm, and a second magnet within the curved channel adjacent to the second arm and aligned with the first magnet.

7. The barbell pad of claim 1 further comprising an adhesive layer between the base and the flexible pad.

8. The barbell pad of claim 1 wherein the flexible pad comprises a foam pad.

9. The barbell pad of claim 1 wherein the base comprises a polymer plastic material.

10. A barbell pad comprising:

a base comprising first and second arms, and a semi-circle shaped channel between the first and second arms, the first and second arms extending laterally away from the semi-circle shaped channel, the first and second arms extending in opposite directions and being substantially parallel to each other;

a plurality of curve-shaped magnets carried by the base within the semi-circle shaped channel and configured to be magnetically coupled to a barbell, each of the plurality of curve-shaped magnets being recessed within the semi-circle shaped channel; and a flexible pad coupled to the base opposite to the plurality of curve-shaped magnets to distribute weight load from the barbell.

11. The barbell pad of claim 10 wherein the first and second arms extend perpendicularly from ends of the semi-circle shaped channel.

12. The barbell pad of claim 10 wherein the flexible pad comprises a first end coupled to the base, and a second end opposite to the first end, the second end being curve-shaped.

13. The barbell pad of claim 10 wherein the plurality of magnets comprises first and second pairs of aligned magnets, each of the first and second pairs of aligned magnets comprises a first magnet within the semi-circle shaped channel adjacent to the first arm, and a second magnet within the semi-circle shaped channel adjacent to the second arm and aligned with the first magnet.

14. The barbell pad of claim 10 further comprising an adhesive layer between the base and the flexible pad.

15. The barbell pad of claim 10 wherein the flexible pad comprises a foam pad; and wherein the base comprises a polymer plastic material.

16. A method for making a barbell pad comprising:

Forming a base comprising first and second arms, and a curved channel between the first and second arms, the first and second arms extending laterally away from the curved channel, the first and second arms extending in opposite directions;

positioning a plurality of magnets carried by the base within the curved channel and configured to be magnetically coupled to a barbell; and coupling a flexible pad to the base opposite to the plurality of magnets to distribute weight load from the barbell.

17. The method of claim 16 wherein each of the plurality of magnets comprises a curve-shaped magnet; and wherein each of the plurality of magnets is recessed within the curved channel.

18. The method of claim 16 wherein the first and second arms are substantially parallel to each other.

19. The method of claim 16 wherein the curved channel comprises a semi-circle shaped channel; and wherein the first and second arms extend perpendicularly from ends of the semi-circle shaped channel.

20. The method of claim 16 wherein the flexible pad comprises a first end coupled to the base, and a second end opposite to the first end, the second end being curve-shaped; and wherein the plurality of magnets comprises first and second pairs of aligned magnets, each of the first and second pairs of aligned magnets comprises a first magnet within the curved channel adjacent to the first arm, and a second magnet within the curved channel adjacent to the second arm and aligned with the first magnet.

* * * * *